US005979734A

United States Patent [19]

Chang

[11] Patent Number: 5,979,734

[45] Date of Patent: Nov. 9, 1999

[54] MULTIPURPOSE STAPLER

[76] Inventor: Hung-Tai Chang, No.16 Alley 4, North Lane 72, Sec. 1, Yu Yuan Rd. Jui Ching Chury Da Tu Hsiang, Taichung Hsien, Taiwan

[21] Appl. No.: 09/136,564

[22] Filed: Aug. 19, 1998

[51] Int. Cl.[6] ..... B25C 5/02

[52] U.S. Cl. ..... 227/76; 227/134; 7/160

[58] Field of Search ..... 227/134, 76, 64, 227/63, 156; 7/160, 170

[56] References Cited

U.S. PATENT DOCUMENTS

| | | | |
|---|---|---|---|
| 3,951,325 | 4/1976 | Mitsuhashi | 227/76 |
| 4,114,793 | 9/1978 | Hsu | 227/76 |
| 4,288,018 | 9/1981 | Taniguchi | 227/76 |
| 4,491,261 | 1/1985 | Mitsuhashi | 227/76 |
| 4,727,610 | 3/1988 | Lin | 227/76 |
| 4,779,785 | 10/1988 | Amagaya | 227/76 |

*Primary Examiner*—Scott A. Smith
*Attorney, Agent, or Firm*—Dougherty & Troxell

[57] ABSTRACT

A multipurpose staper includes a base, a sliding anvil assembly mounted on the base and move between a front side position and rear side position, a magazine and tie plate assembly pivoted to the base above the sliding anvil assembly, a press plate, a top cap pivoted to the base and depressed to force down the press plate, causing the press plate to drive a staple out of the magazine and tie plate assembly, enabling the driven staple to be forced into sheets of paper put on the front end of the base when the sliding anvil assembly is moved to the rear side position, or squeezed into a straight shape when the sliding anvil assembly is moved to the front side position, a front cap mounted on the top cap and moved between a first position to lock the press plate and a second position to unlock the press, and a rear cap pivoted to the top cap and integral with a pencil sharpener for sharpening a pencil.

3 Claims, 6 Drawing Sheets

MULTIPURPOSE STAPLER

BACKGROUND AND SUMMARY OF THE INVENTION

The present invention relates to staplers, and more particularly to a multipurpose stapler which provides various functions for punching a hole on sheets of paper, sharpening a pencil, and squeezing staples into straight pins.

A variety of stationery including staplers, punches, pins, pencil sharpeners, etc., may be used for different purposes when preparing a paper work. It is inconvenient to carry a set of writing materials when one goes out of the office for business or to participate a conference or meeting. Furthermore, when various writing materials are used, much table space will be occupied by the writing materials prepared.

According to the present invention, the stapler is incorporated with punch means for punching a hole on sheets of paper, a pencil sharpener for sharpening a pencil, and a sliding anvil assembly for permitting stapes to be squeezed into a straight shape one by one for use as pins.

DETAILED DESCRIPTION OF THE PREFERRED EMBODIMENT

Figure 1:
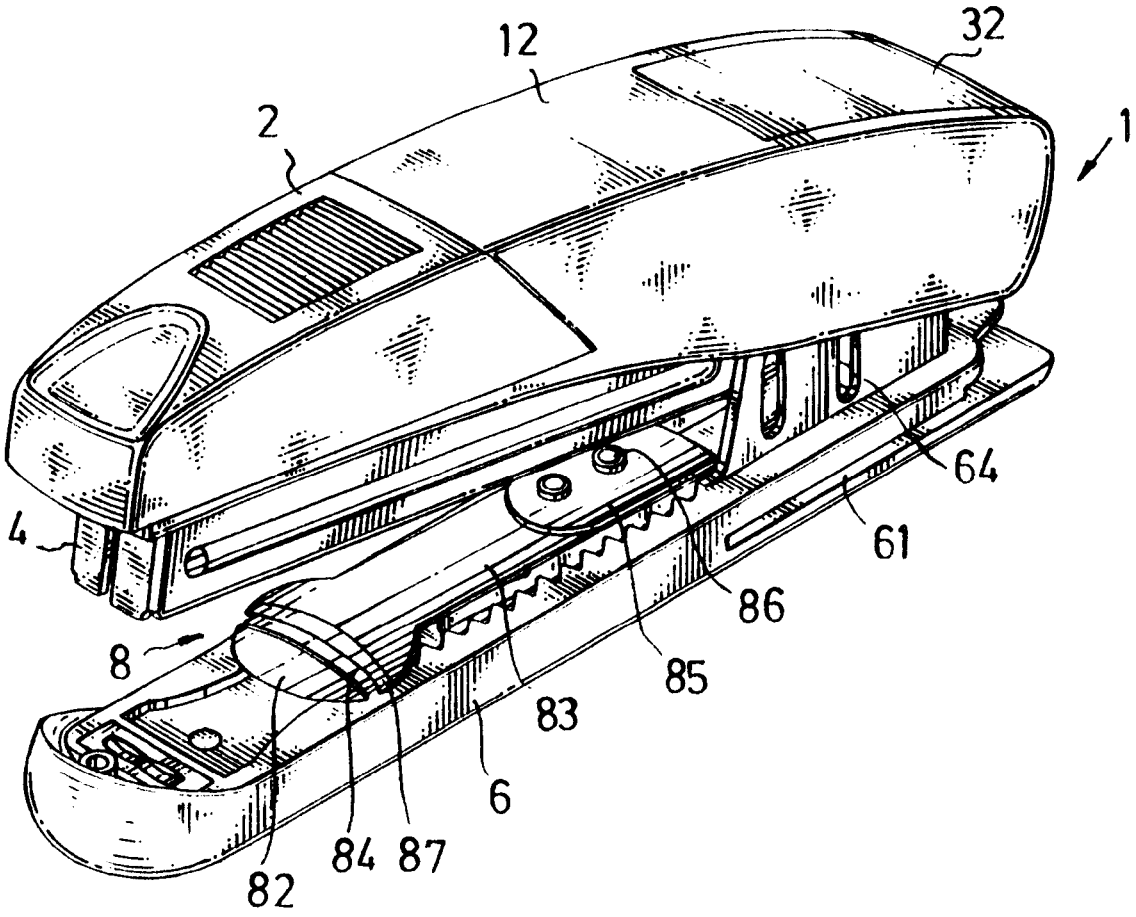
FIG. 1 is a perspective view of a multipurpose stapler according to the present invention.
Figure 2:
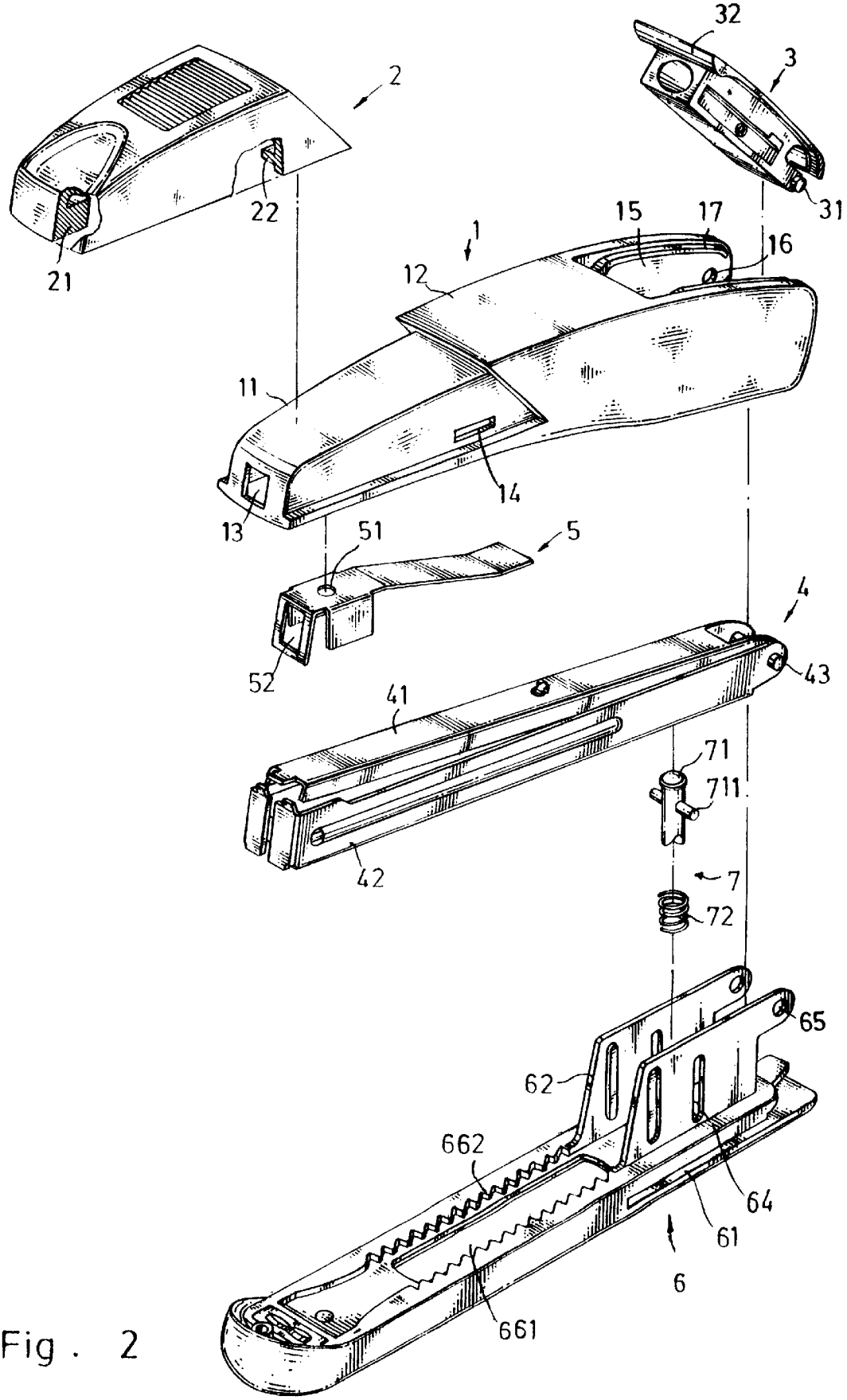
FIG. 2 is an exploded view of the multipurpose stapler shown in FIG. 1 (the sliding anvil assembly excluded).
Figure 3:
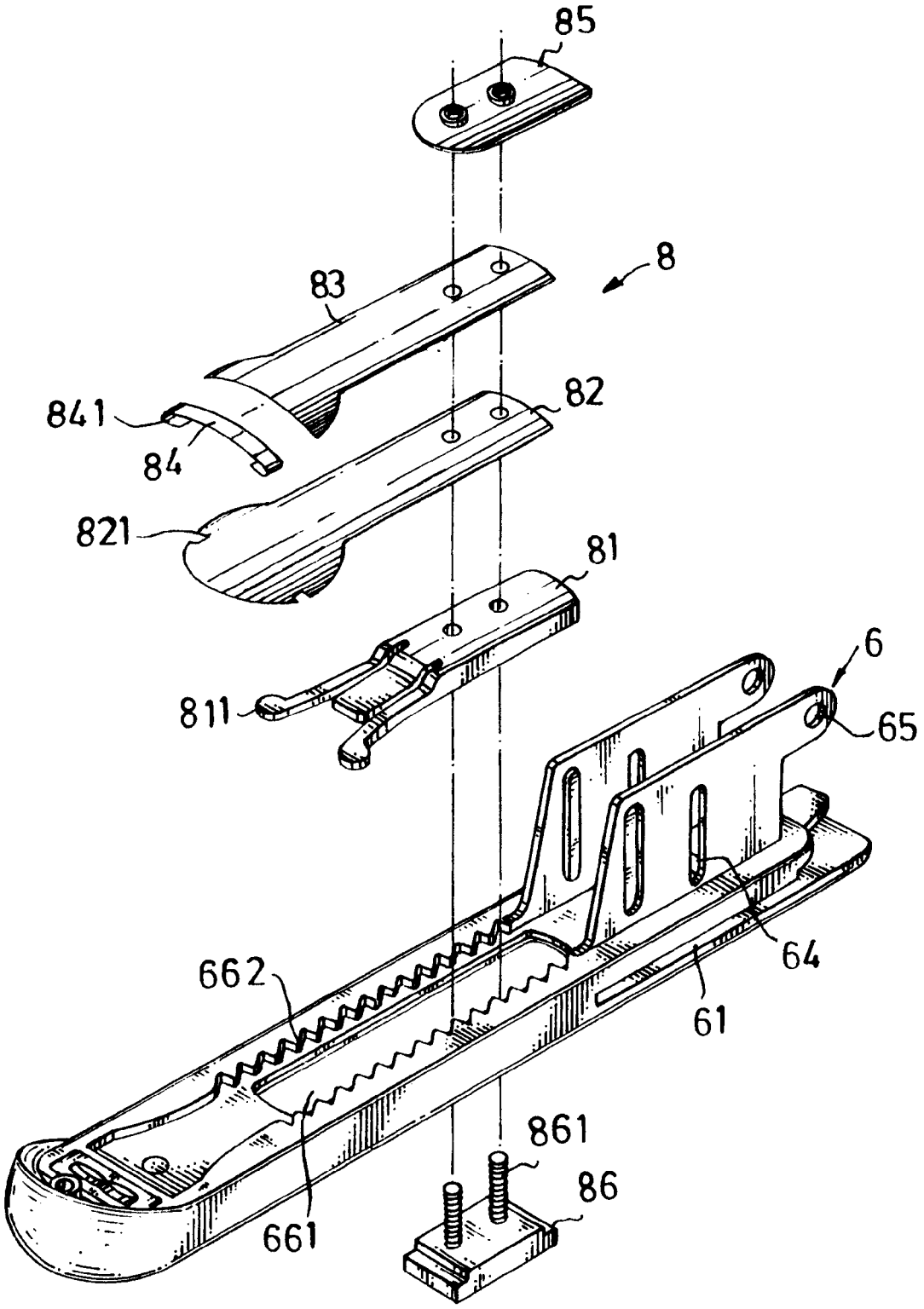
FIG. 3 is an exploded view of the sliding anvil assembly and the base of the multipurpose stapler shown in FIG. 1.

Referring to FIGS. 1, 2 and 3, a multipurpose stapler in accordance with the present invention is generally comprised of a top cap 1, a magazine and tie plate assembly 4, a base 6, a front cap 2, a rear cap 3, a press plate 5, a punch 7, and a sliding anvil assembly 8.

The top cap 1 is a hollow, elongated shell having a body 12 on the middle, a recessed front sliding way 11 in front of the body 12, a rear receiving space 15 at one side of the body 12 remote from the front sliding way 11, a front opening 13 in front of the front sliding way 11, two sliding slots 14 respectively disposed at two downwardly extended vertical side walls of the recessed front sliding way 11, a downwardly extended locating pin 18 beneath the front sliding way 11 behind the front opening 13, two flat inside flanges 17 raised from the inside wall thereof and disposed at two opposite sides of the rear receiving space 15, and two pivot holes 16 respectively provided at the flat inside flanges 17.

The front cap 2 is slidably mounted on the recessed sliding way 11 of the top cap 1 and moved to control the position of the press plate 5, having a locking rod 21 inwardly backwardly raised from a vertical front side wall thereof and inserted into the front opening 13 of the top cap 1, and two coupling rods 22 respectively and inwardly raised from two vertical side walls thereof and inserted into the sliding slots 14. When assembled, the front cap 2 can be moved back and forth on the recessed slding way 11 at a distance within the constraint of the sliding slots 14.

The rear cap 3 is mounted in the rear receiving space 15 of the top cap 1, having two stub pivot pins 31 raised from two opposite vertical side walls thereof near one end and respectively coupled to the pivot holes 16 on the inside flanges 17 of the top cap 1, and an outwardly extended peripheral flange 32, which is stopped above the inside flanges 17 and covered on the rear receiving space 15 when the rear cap 3 is turned inwardly about the axis which passes through the pivot holes 16 and inserted into the rear receiving space 15. According to the present preferred embodiment, the rear cap 3 is integral with a pencil sharpener for sharpening a pencil.

The magazine and tie plate assembly 4 comprises a magazine 42, and a lift cover 41 covered on the magazine 42. The magazine 42 has two pivot rods 43 respectively pivoted to the base 6.

The press plate 5 is coupled between the top cap 1 and the magazine and tie plate assembly 4, having a top mounting hole 51 fastened to the downwardly extended locating pin 18 inside the top cap 1 and a front lock hole 52, which receives the locking rod 21 of the front cap 2.

The base 6 comprises a longitudinal sliding slot 661, two serrated portions 662 arranged along two opposite sides of the longitudinal sliding slot 661, two upright walls 62 arranged in parallel near the rear end thereof and respectively pivoted to the top cap 1, two vertical sliding slots 64 respectively provided at the upright walls 62 on the middle, two pivot holes 65 respectively provided at the upright walls 62 at one end near the top, a horizontal paper insertion slot 61 backwardly extended to the rear end beneath the upright walls, and a through hole 63 perpendicularly upwardly extended upwards from the horizontal paper insertion slot 61 between the upright walls 62.

The punch 7 comprises a punching tip 71 having a cross rod 711 inserted in the vertical sliding slot 64, and a compression spring 72 mounted arund the punching tip 71 and stopped between the base 6 and the cross rod 711 above the through hole 63 at the base 6.

The sliding anvil assembly 8 is mounted on the base 6 and moved along the longitudinal sliding slot 661, comprising a slide 86 moved along the longitudinal sliding slot 661 at the bottom, the slide 86 having two upright rod 861 raised from the top side wall thereof and inserted through the longitudinal sliding slot 661, an elongated carrier plate 81 fastened to the upright rods 861 and moved with the slide 86 along the longitudinal sliding slot 661 at the top, the elongated carrier plate 81 having two springy retaining rod 811 bilaterally raised from a front end thereof and respectively engaged with serrated portions 662 of the base 6, a flat steel plate 82 fastened to the upright rods 861 and carried on the carrier plate 81, the flat steel plate 82 having two locating notches 821 bilaterally provided at the periphery of the expanded, circular front end thereof, a flat bumper plate 83 fastened to the upright rods 861 and covered on the flat steel plate 82, a front transverse plate 84 mounted on the expanded, circular front end of the flat steel plate 82 and defining with the flat bumper plate 83 a guide groove 87, the front transverse plate 84 having two retaining portions 841 at two opposite ends respectively fastened to the locating notches 821 at the flat steel Plate 82, and a cover plate 85 fastened to the upright rods 861 and covered on the flat bumper plate 83.

Figure 4:
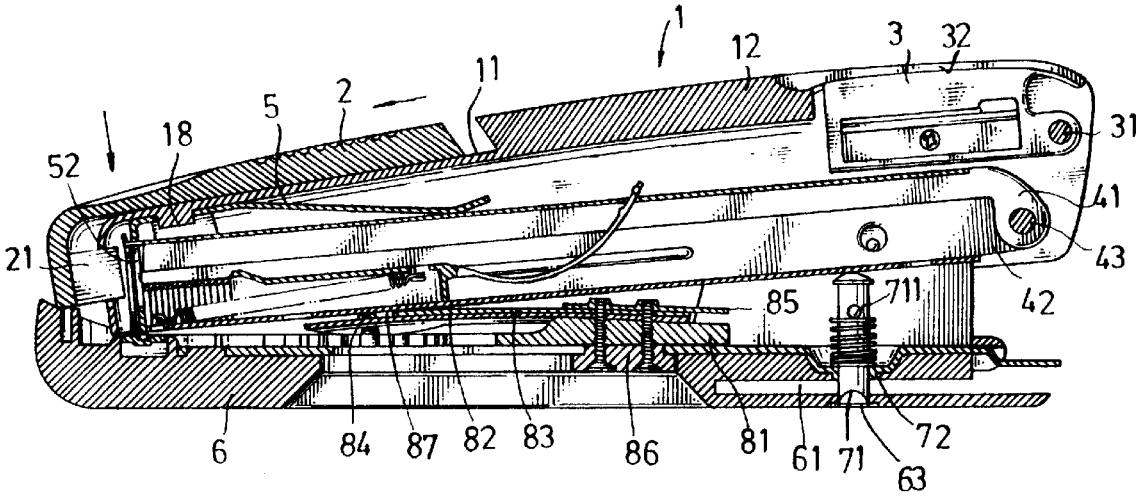
FIG. 4 is a sectional side view of the present invention, showing the front cap moved forwards, the sliding anvil assembly moved to the rear side position, the top cap depressed.

Referring to FIG. 4, when the front cap 2 is moved forwards on the recessed sliding way 11, the locking rod 21 is disengaged from the front lock hole 52, enabling the press plate 5 to be forced downwards by the top cap 1 to drive a staple out of the magazine 42 into sheets of paper when the top cap 1 is pressed down by the user.

Figure 5:
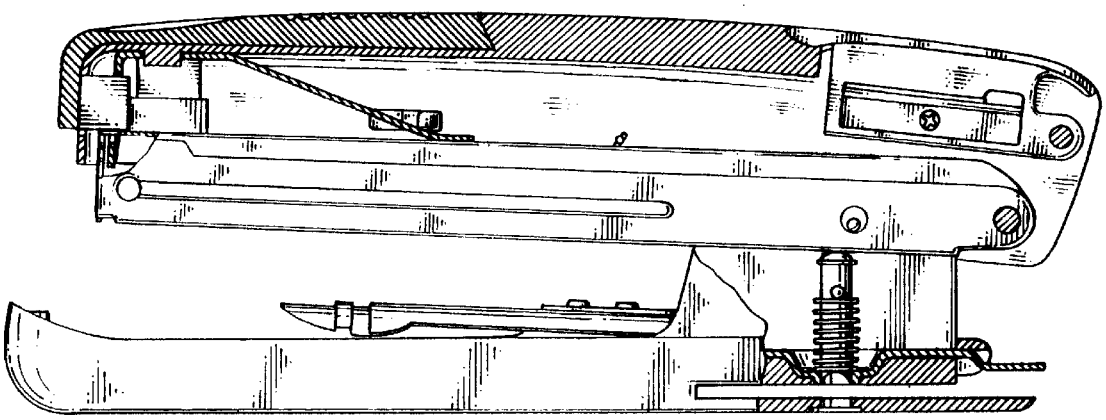
FIG. 5 is another sectional side view of the present invention, showing the front cap moved backwards, the sliding anvil assembly moved to the rear side position.
Figure 6:
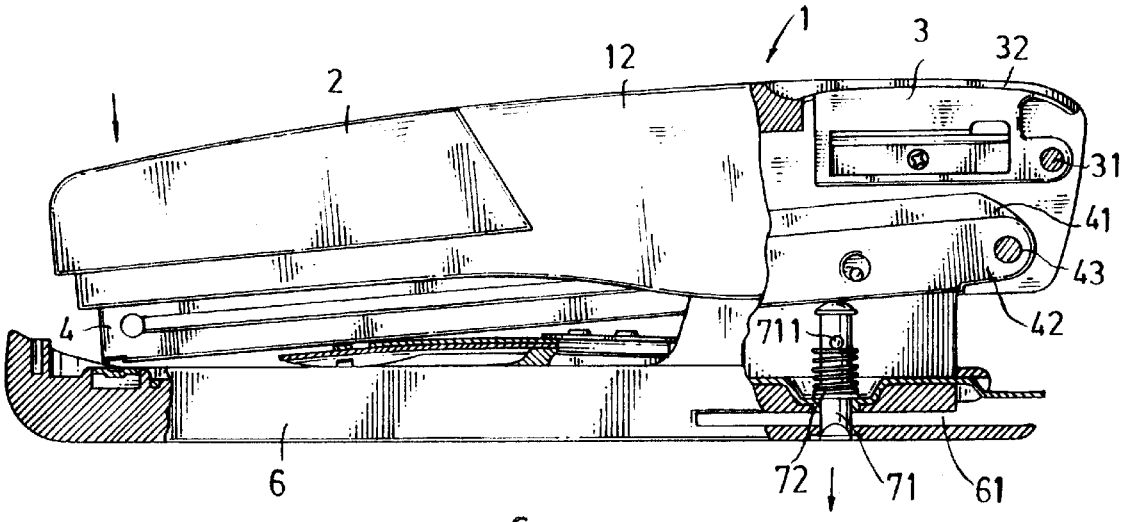
FIG. 6 is similar to FIG. 5 but showing the top cap depressed, the punching tip forced into the through hole on the base.

Referring to FIGS. 4 and 5, when the front cap 2 is moved backwards on the recessed sliding way 11, the locking rod 21 is inserted into the front lock hole 52 to lock the press plate 5 (see FIG. 4). When the press plate 5 is locked, sheets of paper can be inserted into the paper insertion slot 61 and then punched by the punching tip 71. When the top cap 1 is depressed after the press plate 5 has been locked, the punching tip 71 is driven into the through hole 63 through the sheets of paper being inserted into the paper insertion slot 61, and therefore the inserted sheets of paper is punched (see FIG. 6).

Figure 7:
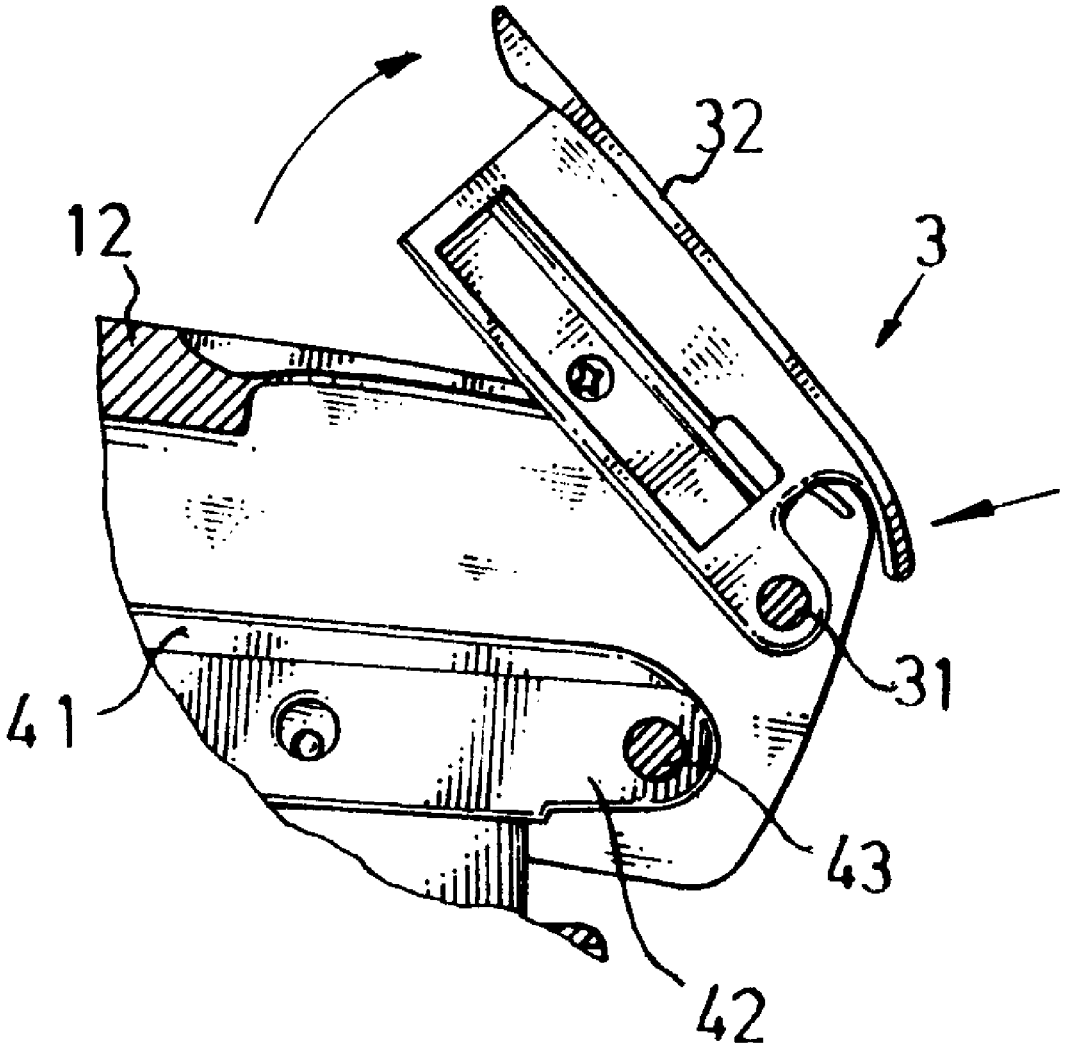
FIG. 7 shows the rear cap turned out of the receiving space of said top cap according to the present invention.

Referring to FIG. 7, the rear cap 3 can be turned outwards from the rear receiving space 15, and used to sharpen a pencil.

Figure 8:
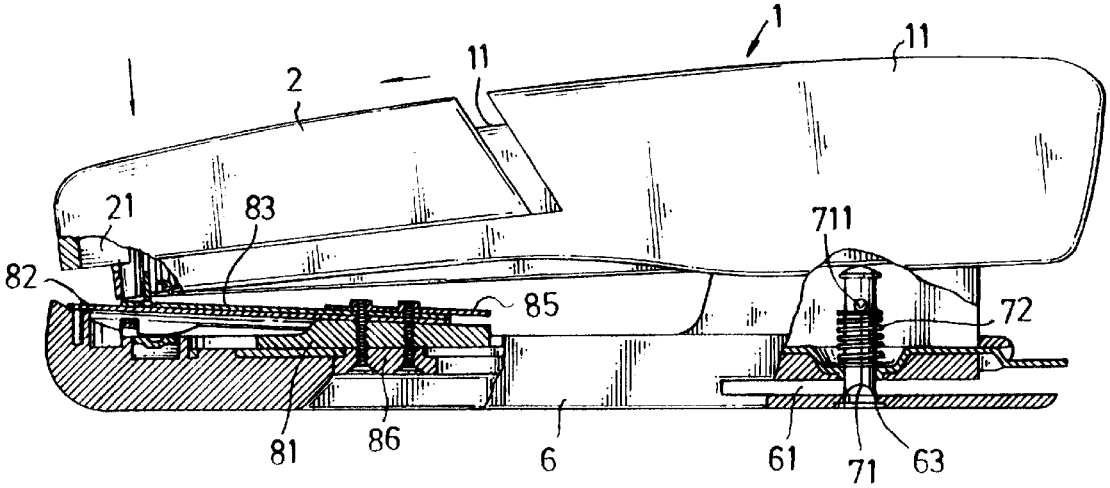
FIG. 8 is still another sectional side view of the present invention, showing the front cap moved forwards, the sliding anvil assembly moved to the front side position, the top cap depressed.

Referring to FIG. 8 and FIG. 4, again, the sliding anvil assembly 8 can be moved from the rear side position shown in FIG. 3 to the front side position shown in FIG. 8. When the sliding anvil assembly 8 is moved to the front side position and the front cap 2 is moved forwards on the recessed sliding wall 11 to disengage the locking rod 21 from the front lock hole 52, depressing the top cap 1 causes one staple to be driven out of the magazine 42 and forced by the press plate 5 into the guide groove 87 and squeezed into a straight wire rod.

I claim:

1. A multipurpose stapler comprising:

a base, said base comprising a longitudinal sliding slot, two upright walls arranged in parallel near a rear end thereof, two vertical sliding slots respectively provided at the upright walls on the middle, a horizontal paper insertion slot backwardly extended to the rear end beneath said upright walls, and a vertical through hole perpendicularly upwardly extended upwards from said horizontal paper insertion slot between said upright walls;

a magazine and tie plate assembly having one end pivoted to said upright wall of said base;

a punch driven by said magazine and the plate assembly to punch a hole on sheets of paper being inserted into said paper insertion slot at said base, said punch comprising a punching tip moved in and out of the vertical through hole on said base, said punching tip having a cross rod inserted the vertical sliding slots on said upright walls of said base, and spring means mounted around said punching tip and stopped between said base and said cross rod of said punching tip above the through hole on said base, said spring means imparting an upward pressure to said punching tip;

a top cap pivoted to the upright walls of said base above said magazine and tie plate assembly, said top cap comprising a recessed front sliding way, a rear receiving space, a front opening in front of said front sliding way, two sliding slots respectively disposed at two downwardly extended vertical side walls of the recessed front sliding way, a downwardly extended locating pin beneath said front sliding way behind said front opening, two flat inside flanges disposed at two opposite sides of said rear receiving space, and two pivot holes respectively provided at said flat inside flanges;

a press plate retained between said magazine and tie plate assembly and said top cap for driving a staple out of said magazine and tie plate assembly upon a downward stroke of said top cap, said press plate having a coupling hole coupled to the locating pin of said top cap and a front lock hole;

a front cap mounted on said top cap and mounted back and forth on said recessed sliding way of said top cap between a first position where said press plate is locked by said front cap and stopped from being force downwards to drive a staple out of said magazine and tie plate assembly, and a second position where said press plate is unlocked and allowed to be forced downwards by said top cap to drive a staple out of said magazine and tie plate assembly, said front cap comprising a locking rod inwardly backwardly raised from a vertical front side wall thereof and inserted into the front opening of said top cap, said locking rod being engaged into the lock hole on said press plate when said front cap is moved to said first position, and two coupling rods respectively and inwardly raised from two vertical side walls thereof and respectively inserted into the sliding slots of said top cap;

a rear cap mounted in the rear receiving space of said top cap, said rear cap having two stub pivot pins raised from two opposite vertical side walls thereof near one end and respectively coupled to the pivot holes on the inside flanges of said top cap, and an outwardly extended peripheral flange, which is stopped above the inside flanges of said top cap and covered on the rear receiving space of said top cap; and a sliding anvil assembly mounted on said base and moved along said longitudinal sliding slot of said base between a front side position and a rear side position, said sliding anvil comprising a slide moved along said longitudinal sliding slot of said base at a bottom side, said slide having two upright rods raised from a top side wall thereof and inserted through said longitudinal sliding slot, an elongated carrier plate fastened to the upright rods of said slide and moved with said slide along said longitudinal sliding slot at a top side, a flat steel plate fastened to the upright rods of said slide and carried on said carrier plate, a flat bumper plate fastened to the upright rods of said slide and covered on said flat steel plate, a front transverse plate fastened to said flat steel plate and defining with said flat bumper plate a transverse guide groove, and a cover plate fastened to the upright rods of said slide and covered on said flat bumper plate;

wherein when said front cap is moved to said second position to unlock said press plate and said sliding anvil assembly is moved to said rear side position, the top cap can be depressed to force down said press plate, causing a staple to be driven out of said magazine and tie plate assembly into sheets of paper put on said base in front of said sliding anvil assembly; when said front cap is moved to said second position to unlock said press plate and said sliding anvil assembly is moved to said front side position, the top cap can be depressed to force down said press plate, causing a staple to be driven out of said magazine and tie plate into the transverse guide groove at said sliding anvil assembly and squeezed into a straight shape; when said front cap is moved to said first position to lock said press plate and said top cap is depressed, said punching tip of said punch is forced into the through hole on said base to punch a hole on sheets of paper being inserted into the paper insertion slot at said base.

2. The multipurpose stapler of claim 1 wherein said rear cap is integral with a pencil sharpener for sharpening a pencil.

3. The multipurpose stapler of claim 1 wherein said base comprises two serrated portions arranged along two opposite sides of said longitudinal sliding slot, and said elongated carrier plate of said sliding anvil assembly comprises two springy retaining rods bilaterally raised from a front end thereof and respectively engaged with the serrated portions of said base.

* * * * *